US006050434A

United States Patent [19]

McNab

[11] Patent Number: 6,050,434

[45] Date of Patent: Apr. 18, 2000

[54] CONTAINER CLOSURE WITH DOUBLE-AXIS RESILIENTLY-BIASING WEB-HINGE STRUCTURE

[76] Inventor: Donald W. McNab, 393 Haines Ave., Burbank, Calif. 90814

[21] Appl. No.: 09/315,225

[22] Filed: May 20, 1999

Related U.S. Application Data

[60] Provisional application No. 60/093,932, Jul. 23, 1998.

[51] Int. Cl.[7] ..... B65D 47/08

[52] U.S. Cl. ..... 215/235; 215/237; 220/838; 222/556

[58] Field of Search ..... 215/235, 237; 220/256, 259, 837, 838, 839, 847; 222/556

[56] References Cited

U.S. PATENT DOCUMENTS

| | | | |
|---|---|---|---|
| 4,403,712 | 9/1983 | Wiesinger | 220/838 X |
| 4,915,268 | 4/1990 | Lay et al. | 220/838 X |
| 5,007,555 | 4/1991 | Beck | 220/838 X |
| 5,067,624 | 11/1991 | Thanisch | 215/235 |
| 5,148,912 | 9/1992 | Nozawa | 215/235 X |
| 5,335,802 | 8/1994 | Brach et al. | 215/235 |
| 5,558,239 | 9/1996 | Dubach | 220/838 X |
| 5,642,824 | 7/1997 | Hess, III et al. | 220/838 X |
| 5,938,087 | 8/1999 | Randall | 222/556 X |

*Primary Examiner*—Nathan J. Newhouse
*Attorney, Agent, or Firm*—Edgar W. Averill, Jr.

[57] ABSTRACT

A captive cover closure for dispensably containing its contents, and including a dispensing cap having a captive cover integrally hinged to it by a double-axis, multi-stable resiliently-biasing, web-hinge structure. The web-hinge structure enables the captive cover to move between multiple stable positions, including a closed position over the dispensing cap and an open position remotely spaced from the dispensing cap. The web-hinge structure has a partially-cylindrical-surface configuration when in the open position, and a pair of hyperbolically oriented film hinges defined by arcuate scores on the concave side of the web-hinge structure. When operated, the web-hinge structure resiliently biases in two snap-action stages to pivot the captive cover along the inner and outer film hinges. The two stage movement transitionally raises and laterally advances the outer film hinge to a position having a greater approach angle to the extended spout tip, thereby enabling the captive cover to clear the extended spout typically found on pharmaceutical dispensing containers.

12 Claims, 4 Drawing Sheets

CONTAINER CLOSURE WITH DOUBLE-AXIS RESILIENTLY-BIASING WEB-HINGE STRUCTURE

The present application claims the benefit of U.S. Provisional Application Ser. No. 60/093,932, filed Jul. 23, 1998, the full disclosure of which is incorporated by reference herein.

BACKGROUND OF THE INVENTION

The field of the invention generally pertains to container closures. The invention relates more particularly to container closures having a dispensing cap and a cover captively movable between a closed position over the dispensing cap and an open position remotely spaced from the dispensing cap by means of a resiliently-biasing web-hinge structure.

Various types of container closures having dispensing caps with hinged captive covers have been utilized in the packaging industry for many years. They have typically been used to package personal care and household chemical products such as shampoos, lotions, cleaning fluids, etc. Many of these container closures utilize a resiliently biasing hinge structure to connect the captive cover to the dispensing cap. The hinge structure has a snap-action biasing force which maintains the captive cover in a desired open or closed bistable position. This is useful to prevent the captive cover from blocking or otherwise interfering in the dispensation and use of the contents contained therein.

For example, in U.S. Pat. No. 4,403,712 an integral snap hinge is shown connecting the body of a bottle closure to a lid. The integral snap hinge directly connects the body and the lid by means of a single, geometric main film hinge and two connecting elements located at each end of the main film hinge. Each connecting element is linked to the body and the lid also by film hinges which merge with the single, geometric main film hinge. The connecting elements and the walls of the hinge members have resiliently biasing properties which produce the bistable snap-action of the integral snap hinge.

In U.S. Pat. No. 5,642,824 a container closure is shown having a base for mounting to a container, and a lid connected to the base by a bistable, snap-action hinge structure. Similar to the integral snap hinge in U.S. Pat. No. 4,403,712, this hinge structure also has resiliently biasing properties producing a bistable, snap-action. However, unlike the integral snap hinge in U.S. Pat. No. 4,403,712, the hinge structure in U.S. Pat. No. 5,642,824 includes a film web having two distinct arcuate film hinges: an arcuate film hinge connecting the web to the base, and an opposing arcuate film hinge connecting the web to the lid. An abutment surface on the base controls the position of the hinge structure.

A resiliently biasing hinge structure similar to U.S. Pat. No. 5,642,824, is shown in U.S. Pat. No. 3,135,456 disclosing a flexible hinge device also having two arcuate film hinges. The hinge device conformably attaches surface-to-surface to a pair of coextensive cylindrical surfaces. only a web portion defined between the two arcuate film hinges remains unaffixed and freely movable. The two arcuate film hinges are hyperbolically opposed along a line of separation between the first and second cylindrical surfaces. And the two arcuate film hinges operate to produce a double hinge effect when the coextensive cylindrical surfaces are moved between open and closed positions relative to each other.

Although the types of container closures and hinge structures disclosed in U.S. Pat. Nos. 4,403,712, 5,642,824, and 3,135,456 have been useful in the personal care and household chemical markets, they do not adequately address the sanitary concerns existing in the pharmaceutical packaging industry. Sanitary dispensation is a paramount concern particularly for liquid pharmaceutical products packaged in liquid dispensing containers, such as oral hygiene products, cough and cold remedies, and topical medications, as well as products specifying liquid dosage amounts. Liquid pharmaceutical products are susceptible to dirt and bacteria contamination near and around the liquid discharge openings during a course of repeated use. Traditionally, nasal or dropper type caps have been designed with a separate tip inserted into the neck opening of a container, and a threadedly mating cap cover used to cover the separate tip. The nasal or dropper type caps typically have an extended spout tapered to a narrow tip which permits controlled dispensation in small quantities. However, because of its extended tip, the mating cap cover has been limited to non-captive covers mounting to and covering the cap.

The captive cover hinge structures disclosed in U.S. Pat. Nos. 4,403,712, 5,642,824, and 3,135,456, however, have inherent structural constraints which prevent the captive covers from clearing extended spouts when moved between open and closed positions over extended spouts.

In U.S. Pat. No. 4,403,712 the single, geometric main film hinge of the integral snap hinge functions as the sole pivot axis for moving the lid portion over the cap portion. When the hinge is operated, the pivot axis remains fixed and in a common plane with the top of the cap and the underside of the cover. This prevents the cover from clearing the extended spout of typical pharmaceutical dispensing caps; only spouts having relatively shallow heights can be cleared.

Likewise, in U.S. Pat. No. 5,642,824, the structural limitations of the biasing hinge structure prevent the lid from clearing the extended spout when moved to the closed position. In its preferred commercial embodiment, the proximity of the two arcuate film hinges causes the two hinges to approximate a single pivot axis when the hinge structure is operated. Similar to the snap hinge in U.S. Pat. No. 4,403,712, the single pivot fulcrum effectively remains fixed on the same elevational and vertical planes when the hinge is operated between the closed and open positions. Consequently, the lid is also not sufficiently elevated, laterally advanced, or otherwise advantageously repositioned to clear an extended spout of typical pharmaceutical dispensing caps.

Although the flexible hinge device in U.S. Pat. No. 3,135,456 utilizes two arcuate film hinges to create a double hinging effect, its orientation and attachment to the cover and container combination precludes any substantial elevation of the captive cover to clear an extended spout. In particular, the vertically hyperbolic orientation of the two arcuate film hinges at substantially the same vertical plane as the pair of coextensive cylindrical surfaces cancels the effect of any increase in distance between the apexes of the two arcuate film hinges. Any increase in spacing between the hinges to effect sufficient elevation and/or lateral movement of the captive cover to a superior approach position is undermined by the proportionally distanced location of the apex of each hinge from the respective contacting surface of the base or lid. Consequently, the cover maintains approximately the same shallow approach angle at the tip of an extended spout, regardless of variations in spacing between the hinge apexes.

Additionally, in U.S. Pat. No. 3,135,456, because only the web portion remains unaffixed to the pair of cylindrical surfaces, the resilient properties of the attached portions of the hinge device cannot be used to facilitate the snap-action at the two hinge axes. Further, the flexible hinge device can only be used with container and cover combinations having curved hinge attachment surfaces.

BRIEF SUMMARY OF THE INVENTION

It is an object of the present invention to provide an improved container closure having a double-axis resiliently-biasing web-hinge structure with an elevatable and laterally advancing pivot axis which transitionally repositions and maneuvers a captive cover to clear the extended spout of a pharmaceutical fluid dispensing cap.

It is a further object of this invention to provide an improved container closure having a double-axis resiliently-biasing web-hinge structure affixable to curved and flat surfaces alike.

It is a still further object of this invention to provide a commercially moldable one-piece container closure having a double-axis resiliently biasing web-hinge structure integrally molded with the dispensing cap and the captive cover.

The present invention is for a container closure having a dispensing cap, and a captive cover connected to the dispensing cap by means of a double-axis resiliently-biasing web-hinge structure. The web-hinge structure enables the captive cover to move between multiple stable positions, including a closed position over the dispensing cap and an open position remotely spaced from the dispensing cap. The web-hinge structure has a partially-cylindrical-surface configuration when in the open position, and has an axis of curvature intersecting the central axes of the dispensing cap and the captive cover. A pair of hyperbolically oriented arcuate scores on the concave side of the web-hinge structure define an inner film hinge and an outer film hinge. The inner and outer film hinges together divide the partially-cylindrical-surface configuration into three sections, including a central web portion, an inner beam portion, and an outer beam portion.

When operated, the web-hinge structure resiliently biases in two snap-action stages to pivot the captive cover along the inner and outer film hinges. The two stage movement transitionally elevates and laterally advances the outer film hinge to a higher and radially closer spacial position to the tip of an extended spout relative to the inner film hinge. This maneuvers the captive cover to a superior approach position with a greater approach angle, thereby enabling the captive cover to clear the extended spout of a pharmaceutical fluid dispensing cap.

DETAILED DESCRIPTION OF THE PREFERRED EMBODIMENTS

Figure 1:
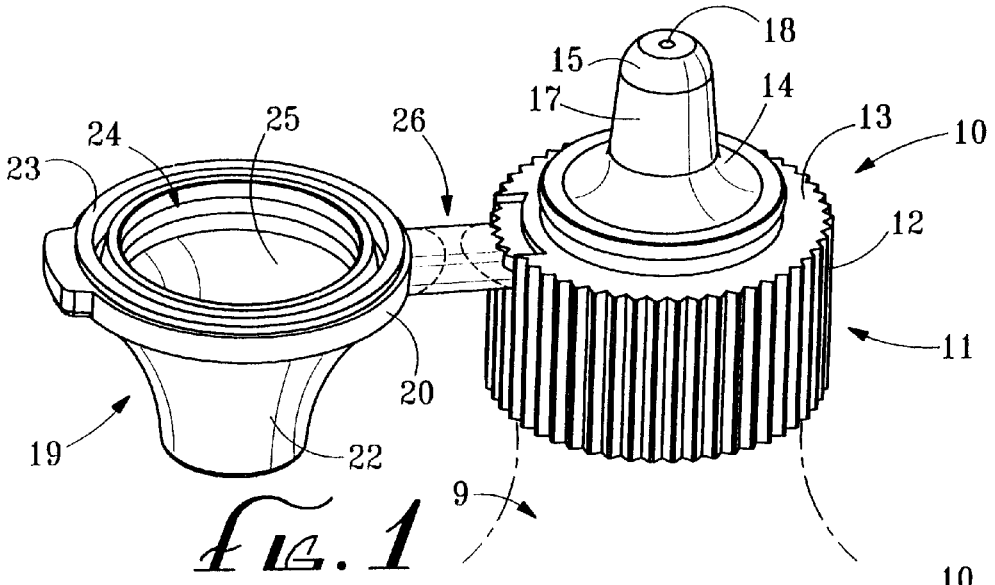
FIG. 1 is a perspective view of the captive cover closure in an open position.
Figure 2:
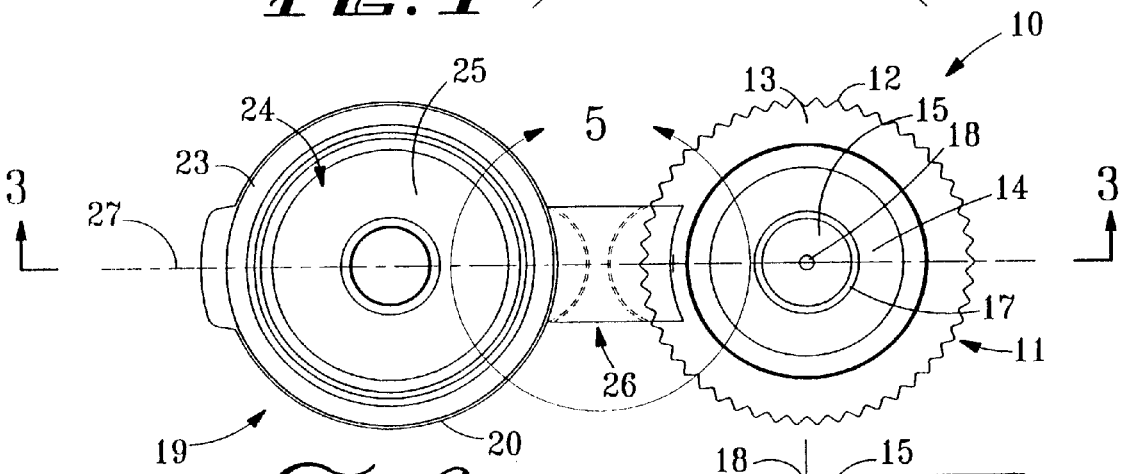
FIG. 2 is a top view of the captive cover closure of FIG. 1.
Figure 3:
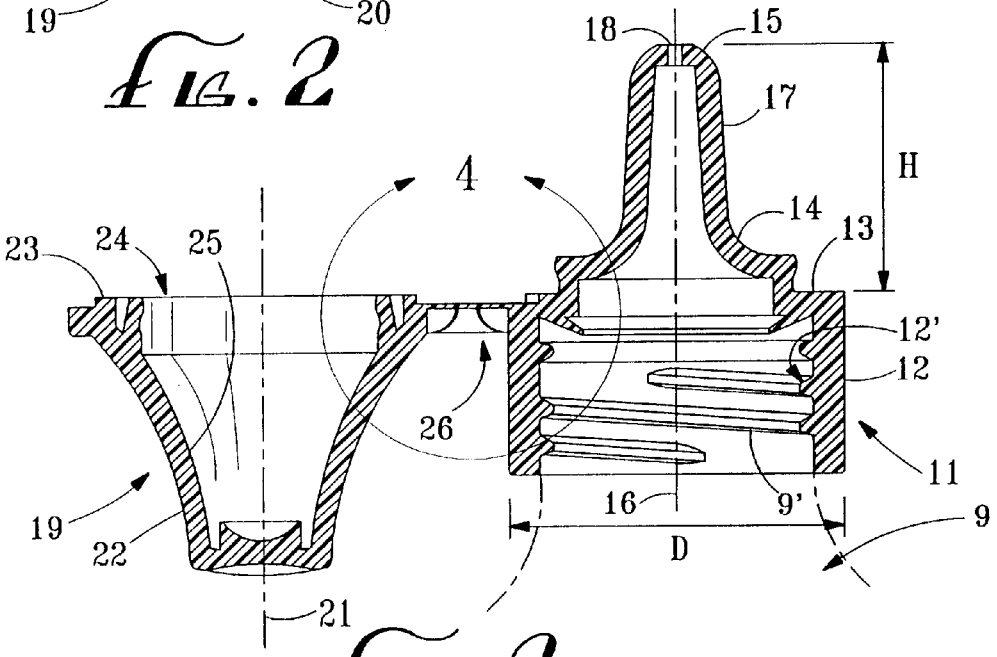
FIG. 3 is a side elevational view of the captive cover closure of FIG. 1.
Figure 4:
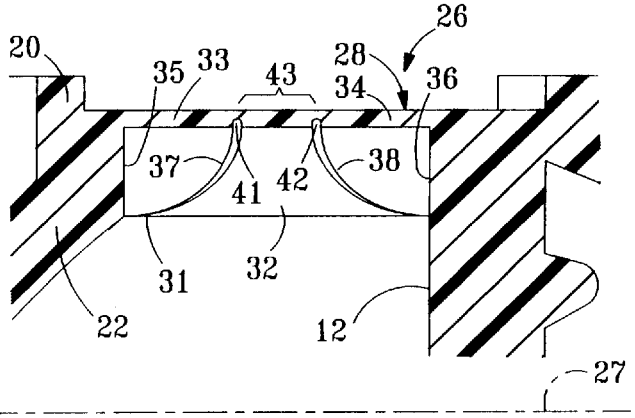
FIG. 4 is an enlarged side view of the circle 4 in FIG. 3 showing the details of the web-hinge structure.

Referring now to the drawings, FIGS. 1–3 show a captive cover closure, generally indicated at 10. The captive cover closure 10 includes a dispensing cap, generally indicated at 11, a cover, generally indicated at 19, and a web-hinge structure, generally indicated at 26, hingedly connecting the cover 19 to the dispensing cap 11.

As can be best seen in FIGS. 1–3, the dispensing cap 11 includes a cap skirt 12 having a diameter D (FIGS. 3 and 9) joined to a transverse deck 13. Preferably the cap skirt 12 has a cylindrically-shaped configuration with a circular transverse cross-section. Alternatively, however, the cap skirt 12 may have a multiple, planar surface configuration with a polygonal transverse cross-section. The cap skirt 12 has suitable means, preferably a conventional thread 12' (FIG. 3), to sealably mount to a threaded container opening 9' of a container, generally indicated at 9. A spout 14 having a height H (FIGS. 3 and 9) extends normally from the transverse deck 13 to a spout tip 15 located along a central axis 16 (FIG. 3) of the cap skirt 12. A discharge opening 18 is located at the end of the spout tip 15 whereby the contents of the container 9 may be dispensed. In a preferred embodiment, the spout 14 has an elongated shank 17 extending to a narrow spout tip 15. And preferably, the discharge opening 17 is suited for discharging a liquid, but is not limited only to such. The dimensions of the discharge opening 18 may be varied to discharge contents of various types and properties, including granular solids.

The cover 19 is captively movable between a closed position (FIG. 10) over the spout 14, and an open position (FIGS. 1–3) remotely spaced from the dispensing cap 11. This is particularly advantageous when dispensing pharmaceutical solutions such as eye drops: because the cover cannot be separated from the cap, it cannot be placed on an unhygienic surface and possibly lead to contamination of the discharge tip. The cover 19 comprises a cover skirt 20 having a central axis 21 (FIG. 3), and joined to a spout cover portion 22. The spout cover portion has an inner surface 25 which preferably contours to the spout 14, and has means for occluding the discharge opening 18 when in the closed position. The cover skirt 20 has a transverse rim surface 23 at an open end 24 which contacts or at least confronts the transverse deck 13 of the dispensing cap 11 when in the closed position (see FIG. 10). Like the cap skirt 12, the cover skirt 20 also has a preferably cylindrically-shaped configuration with a circular transverse cross-section. However, the shape of the cover skirt 20 will generally follow the shape and contour of the cap skirt 11.

The web-hinge structure 26 connects the cover 19 to the dispensing cap 11, and moves the cover 19 between the open and closed positions. As can be best seen in FIGS. 4–6, 7A and 7D, the web-hinge structure 24 generally has a partially-cylindrical-surface configuration when in its open position (FIGS. 7A and 7D), and has an axis of curvature 27 (FIGS. 2 and 4–6) intersecting the cap central axis 16 and the cover central axis 21. This configuration includes a convex top surface 28, a concave bottom surface 29, a first side edge 30, and a second side edge 31 opposite the first side edge 30. The web-hinge structure 26 has three main sections of its partially-cylindrical-surface configuration between the first and second side edges 30, 31. They include a central web portion 32, an inner beam portion 33, and an outer beam portion 34.

Figure 5:
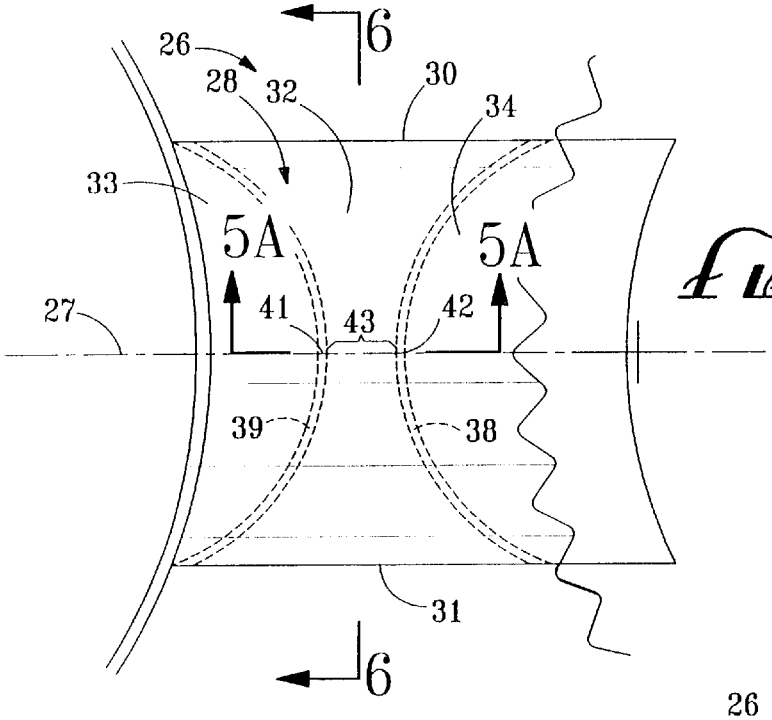
FIG. 5 is an enlarged top view of the circle 5 in FIG. 2 showing the details of the web-hinge structure.
Figure 5A:
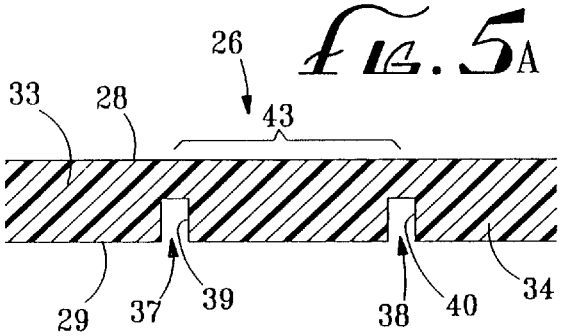
FIG. 5A is an enlarged, cross-sectional view taken along the line 5–5A in FIG. 5.
Figure 6:
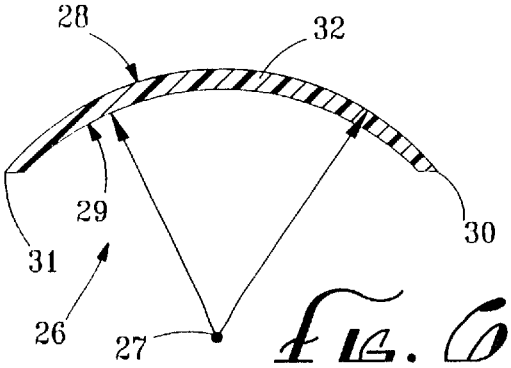
FIG. 6 is an enlarged end view of the web-hinge structure taken along the line of 6—6 of FIG. 5.

The central web portion 32 is located between said inner and outer beam portions 33, 34 and connects to the inner beam portion 33 by an inner film hinge 37, and to the outer beam portion 34 by an outer film hinge 38. As can be best seen in FIG. 5A, the inner film hinge 37 is defined by a first arcuate score 39 on the concave bottom surface 29 between the first and second side edges 30, 31 (see FIG. 5). And the outer film hinge 38 is defined by a second arcuate score 40 on the concave bottom surface 29 between the first and second side edges 30,31 and hyperbolically opposite said first arcuate score 39. Preferably, the inner and outer film hinges 37, 38 each have the same radius of curvature. Further, where the cap skirt 12 and cover skirt 20 has a cylindrically-shaped configuration, the radius of curvature of the inner and outer film hinges 37, 38 is preferably less than the radius of curvatures of the cap skirt 12 and cover skirt 20. The central web portion 32 also has a center space 43 between apexes 41, 42 of the inner and outer film hinges 37, 38, respectively, defined as the shortest distance between the inner and outer film hinges 37, 38. Preferably, the center space 43 has a width not less than one-third the distance between the inner and outer film hinges 37, 38 at the first and second side edges 30, 31.

The inner beam portion 33 extends to a curved inner web end 35 and fixedly secures to the cap skirt 12 at the curved inner web end 35. And the outer beam portion 34 extends to a curved outer web end 36 and fixedly secures to the cover skirt 20 at the curved outer web end 36. Preferably the curved outer web end 36 is affixed to the cover skirt 20 at a position on the skirt below the transverse deck 13 equal to one-half the distance of the center space. Likewise, the curved inner web end 35 is preferably affixed to the cap skirt 12 at a position on the cap skirt below the transverse rim surface 23 also equal to one-half the distance of the center space. However, the respective points of attachment on the cap skirt 12 and the cover skirt 20 may vary, so long as the combined distances below the transverse deck 13 and the transverse rim surface 23 is substantially equivalent to the width of the center space 43.

In a preferred commercial embodiment, wherein the container closure 10 is manufactured via an injection molding process, the thickness of the web-hinge structure 26 is 0.015 inch, the depth of each arcuate score 39, 40 is 0.007 inch, and the width of the central space 43 between the apexes 41, 42 of the arcuate scores 39, 40 is 0.089 inch. And the height of the web-hinge structure, defined as the distance between the apex of the convex top surface 28 to a plane connecting the first and second side edges 30, 31, is preferably 0.071 inch. The dimensions noted are for 15 mm diameter closures and may increase or decrease depending on the size of the closure.

The web-hinge structure 26 has resiliently biasing properties enabling it to store energy and regain its original shape, thereby producing a snap-action operation between the open and closed positions of the container closure 10. Preferably, the container closure 10, including the web-hinge structure 26, is molded from polypropylene or other suitable plastic material capable of durably withstanding repeated opening and closing cycles without failure. Additionally, the web-hinge structure 26 is preferably molded as a unitary part of the container closure 10, together with the dispensing cap 11 and the cover 18.

Figure 7A:
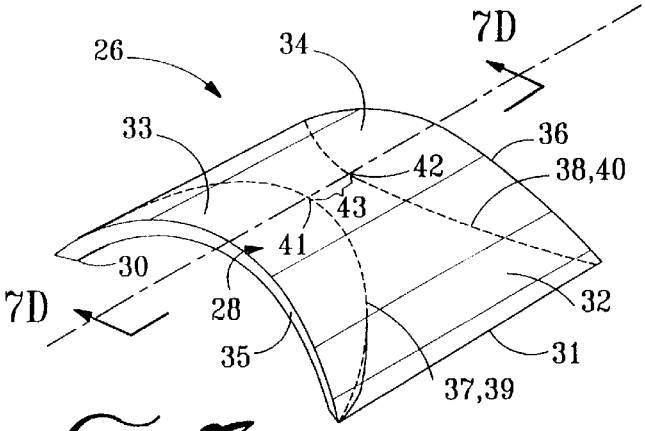
FIG. 7A is a perspective view of the web-hinge structure in the unbiased initial state.
Figure 7D:
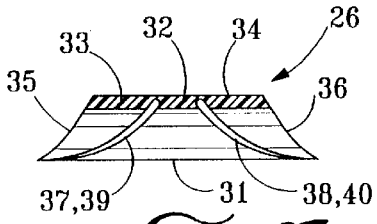
FIG. 7D is a side view of the web-hinge structure taken along the line 7D in FIG. 7A.
Figure 7B:
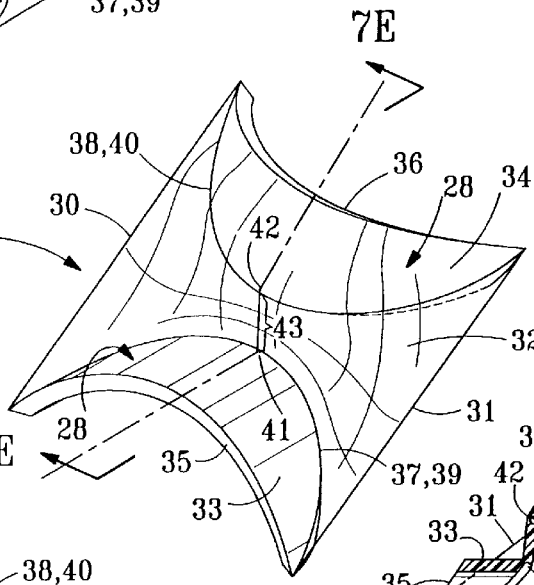
FIG. 7B is a perspective view of the web-hinge structure in the partially-biased intermediate state.
Figure 7E:
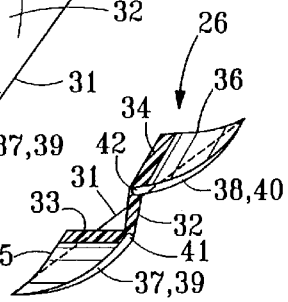
FIG. 7E is a side view of the web-hinge structure taken along the line 7E in FIG. 7B.
Figure 7C:
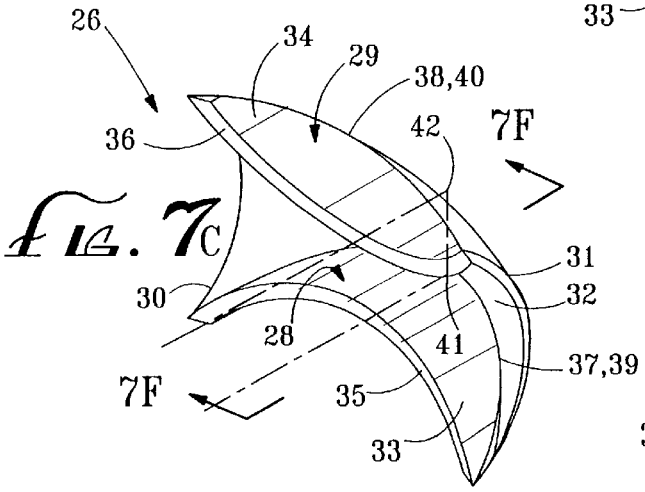
FIG. 7C is a perspective view of the web-hinge structure in the fully-biased final state.
Figure 7F:
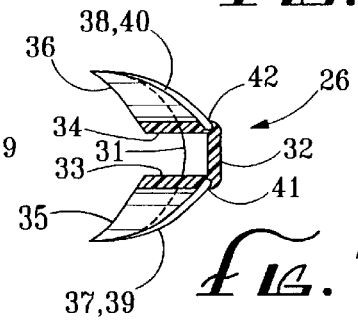
FIG. 7F is a side view of the web-hinge structure taken along the line 7F in FIG. 7C.

FIGS. 1–3, 7A–F, 9 and 10, best illustrate the dynamic operation of the web-hinge structure 26 for opening and closing the attached captive cover 19. Operation of the web-hinge structure 26 involves a two-step snap-action movement between multiple stable positions, including the closed position and the open position. Specifically, the web-hinge structure 26 has three states of dynamic equilibrium as best shown in FIGS. 7A–F: an unbiased initial state (FIGS. 7A and 7D), a partially-biased intermediate state (FIGS. 7B and 7E), and a fully-biased final state (FIGS. 7C and 7F). In the open position, the web-hinge structure 26 is in its unbiased initial state, and maintains its original partially-cylindrical-surface configuration (FIGS. 7A and 7D). In this first unbiased state, the cover 19 is remotely located away from the spout 14 and spout tip 15 of the dispensing cap 11, as shown in FIGS. 1–3, for unobstructed dispensing of the fluid contents.

Figure 9:
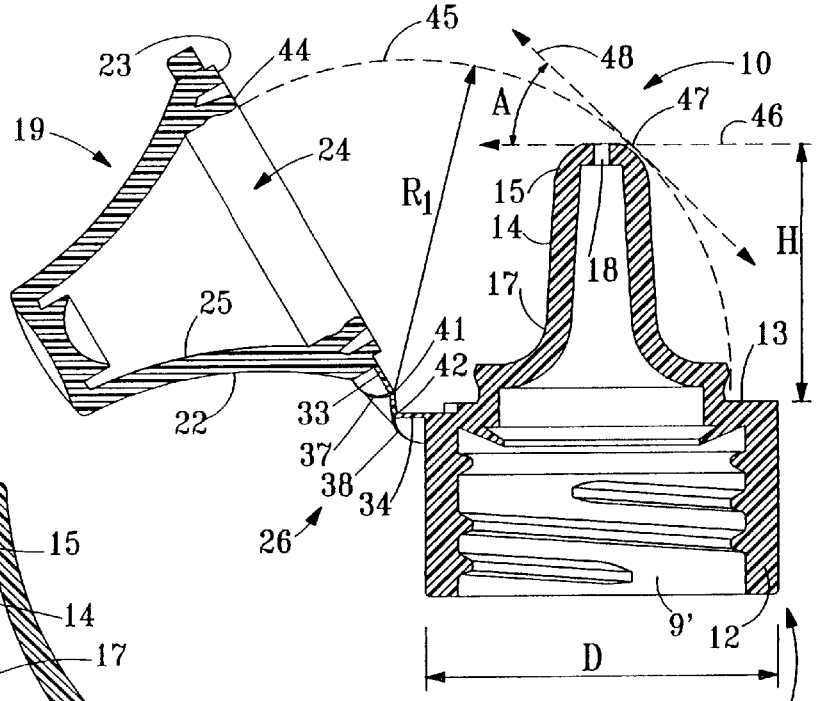
FIG. 9 is a cross-sectional side view of the captive cover closure with the web-hinge structure in the intermediate state as shown in FIGS. 7B and 7E, and illustrating the kinematic trajectory of the captive cover between the intermediate and final states.

From the unbiased initial state, the web-hinge structure 26 can be actuated to resiliently bias along one of its two arcuate film hinges 37, 38 until the intermediate state (FIGS. 7B, 7E, and 9) is reached. As shown in FIGS. 7B, 7E, and 9, both the central web portion 32 and the outer beam portion 33 are angled approximately ninety degrees from the unbiased initial state. Although each film hinge 37, 38 pivots independent of the other, the resilient biasing of one film hinge (38 in FIG. 7B and 7E) affects the resilient biasing of the other film hinge (37 in FIG. 7B and 7E). In the intermediate state, the pivoting film hinge 38 distorts the uniform curvature of the web-hinge structure 26 at the central web portion 32. Additionally, this distortion also partially distorts the curvature of the beam portion 33 near the apex 41 of the yet unpivoted film hinge 37 (see FIGS. 7B and 9). This partial distortion assists the transition from the intermediate state to the final fully-biased state by reducing the force required to bias and pivot the second film hinge 37. For this reason, both the inner and outer beam portions 34, 33 of the web-hinge structure 26 remain free and unaffixed at its convex top and concave bottom surfaces 28, 29.

Figure 10:
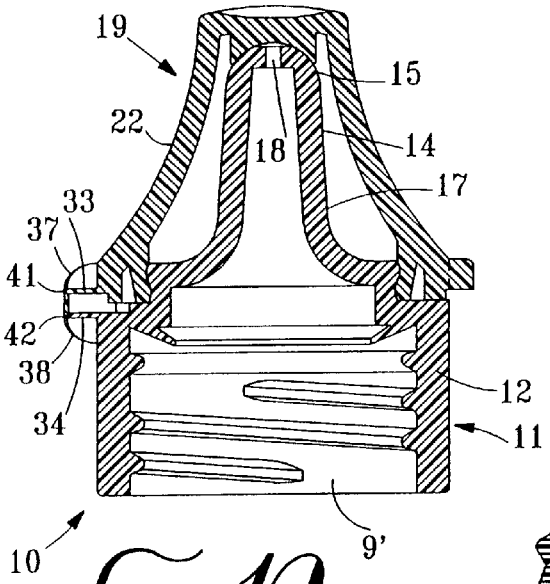
FIG. 10 is a cross-sectional side view of the captive cover closure in the closed position with the web-hinge structure in the final state.

And finally, the transition from the intermediate state to the final state is achieved by actuating the web-hinge structure 26 to bias the remaining film hinge 37. As shown in FIGS. 7C, 7F, and 10, the convex top surface 28 at the outer beam portion 33 is substantially parallel with and located above the convex top surface 28 at the inner beam portion 34, when in the final closed position. Further, the inner and outer film hinges 38, 37 remain distanced from the cap skirt 12 equal to the length of the inner and outer beam portions 34, 33, respectively.

In this manner the dynamic operation of the web-hinge structure 26 raises the apex 41 of the outer film hinge 37 to a higher elevational plane relative to the apex 42 of the inner film hinge 38, as well as laterally advancing the apex 41 of the outer film hinge 37 towards the dispensing cap 11 (see FIGS. 9 and 10). This movement enables the captive cover 19 to clear the extended spouts 14 of pharmaceutical fluid dispensing caps 11 which are commonly manufactured with the height H (FIGS. 3 and 9) of the extended spout 14 directly proportional to the diameter D (FIGS. 3 and 9) of the dispensing cap 11. Pharmaceutical fluid dispensing caps 11 are typically manufactured in diameter sizes ranging from 13 mm to 20 mm, and the spout height to cap diameter ratio (H/D) is typically 3:4 or 75%. Therefore the wider the diameter D of the dispensing cap 11 the longer the height H of the spout 14.

Specifically, as can be best seen in FIG. 9, clearance of the extended spout 14 is made possible by the combined elevational and laterally advancing effect produced by the web-hinge structure 26 which transitionally relocates the cover 19 to a superior approach position. As can be seen in FIG. 9 the captive cover 19 has a generally circular trajectory 45 between the intermediate and final states. The trajectory 45 charts the position of the captive cover 19 as it pivots along the outer film hinge 37 between the intermediate and final states. In particular the trajectory 45 follows a point 44 on the inner surface 25 at the open end 24 of the captive cover 19 opposite the web-hinge structure 26. The trajectory 45 has a radius $R_1$ between the point 44 and the outer film hinge 37, and crosses a spout height line 46 at an intersection point 47. As shown in FIG. 9, the intersection point 47 is spaced away from the spout tip 15 to allow sufficient clearance past the extended spout 14. Additionally, a tangent line 48 of the trajectory 45 at the intersection point 47 forms and defines an approach angle A with the spout height line 46. Thus the captive cover 19 of FIGS. 9 and 10 is transitionally repositioned to sufficiently clear the spout tip 15 of a spout 14 having an elongated shank 17 when the cover 19 is moved from the open position to the closed position.

Figure 8:
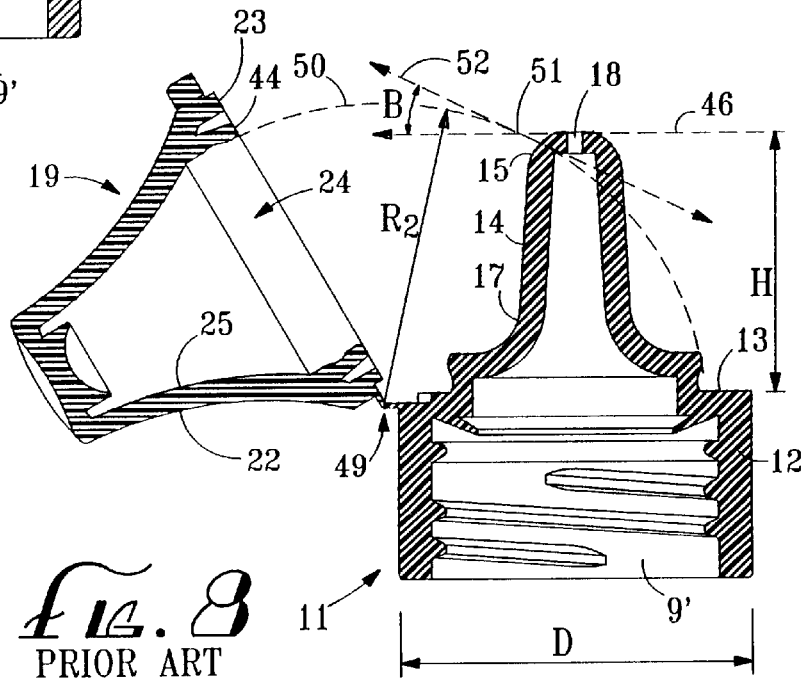
FIG. 8 PRIOR ART
FIG. 8 is a cross-sectional side view of a prior art container closure having a single-axis hinge, and illustrating the kinematic trajectory of the prior art captive cover.

However, clearing extended spouts 14 of pharmaceutical fluid dispensing caps 11 is problematic for non-pharmaceutical captive covers because of their inability to raise and/or laterally advance a pivot axis to a superior approach position. As can be seen in FIG. 8, a general single-axis hinge 49 commonly used in the prior art is shown forming a generally circular trajectory 50, similar to the trajectory 45 in FIG. 9. For comparative purposes, the same dispensing cap 11 and cover 19 of FIGS. 1–3, 9, and 10, as well as the dimensions, are used in conjunction with the single-axis hinge 49 of a typical prior art closure in FIG. 8. In particular, the spout 17 in FIG. 8 also has a height H, and the dispensing cap 11 also has a diameter D typical of extended spouts 17 of pharmaceutical fluid dispensing caps.

As shown in FIG. 8, the trajectory 50 also charts the position of the point 44 on the inner surface 25 at the open end 24 of the captive cover 19 opposite the single-axis hinge 49. The trajectory 50 has a radius $R_2$, less than $R_1$, between the point 44 and the single-axis hinge 49, and crosses the spout height line 46 at an intersection point 51. As illustrated in FIG. 8, the intersection point 51 is located at the spout tip 15, whereby the extended spout 14 effectively prevents closure. FIG. 8 also shows an approach angle B defined between the spout height line 46 and a tangent line 52 of the trajectory 50 at the intersection point 51. As can be seen in FIGS. 8 and 9, the approach angle B is less than the approach angle A and results in a more shallow approach for the cover 19. Consequently, the kinematics of the captive cover 19 movable by a prior art single-axis hinge 49 makes clearing extended spouts 14 of typical pharmaceutical dispensing caps 11 problematic for non-pharmaceutical captive covers.

Attaining the required elevation and laterally advancing movement for spout clearance does not depend on a particular biasing sequence of the inner and outer film hinges 37, 38. However, one preferred sequence of the snap-action involves the inner film hinge 37 biasing first, followed by the outer film hinge 38.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A closure for a container opening, said closure comprising:

a cap for mounting over a container opening, said cap having a cap central axis and a discharge opening at a tip of a discharge spout;

a cover movable between a closed position over the discharge spout occluding the discharge opening and an open position remotely spaced from the discharge opening, said cover having a cover central axis; and a snap-action resiliently-biasing web-hinge structure hingedly movable between an open position and a closed position, and generally having a partially-cylindrical-surface configuration when in its open position, with an axis of curvature intersecting the cap central axis and the cover central axis, a convex top surface, a concave bottom surface, a first side edge 30, and a second side edge 31 opposite the first side edge, said web-hinge structure including:

an inner beam portion (33) extending to a curved inner web end (35) and fixedly secured to the cap at the curved inner web end;

an outer beam portion (34) extending to a curved outer web end (36) and fixedly secured to the cover at the curved outer web end; and a central web portion (32) between said inner (33) and outer (34) beam portions, said central web portion (32) connected to the inner beam portion (33) by an inner film hinge (37) defined by a first arcuate score (39) on the concave bottom surface between the first (30) and second (31) side edges, and said central web portion (32) connected to the outer beam portion (34) by an outer film hinge (38) defined by a second arcuate score (40) on the concave bottom surface between the first (30) and second (31) side edges and hyperbolically opposite said first arcuate score (39), wherein the shortest distance between said inner and outer film hinges is a center space (43) between an apex (41) of the inner film hinge and an apex (42) of the outer film hinge, whereby the inner and outer film hinges hinge independent of the other, and the apex of the outer film hinge can be raised to a higher elevational plane relative to the apex of the inner film hinge and laterally advanced to a radially closer spacial position to the cap central axis, for clearing the tip of the discharge spout when the cover is moved between the open and closed positions.

2. A closure as in claim 1, wherein the discharge spout of said cap has an elongated shank, and wherein the discharge opening is located at an apex of said elongated-shank.

3. A closure as in claim 1, wherein the web-hinge structure is unitary with the cap and cover.

4. A closure as in claim 1, wherein the web-hinge structure has a substantially uniform thickness.

5. A closure as in claim 1, wherein the first and second side edges of the web-hinge structure are parallel.

6. A closure as in claim 1, wherein the distance between the first side edge and the second side edge is less than an average diameter of the cap and less than an average diameter of the cover.

7. A closure as in claim 1, wherein the inner film hinge is symmetric to the outer film hinge along a longitudinal axis of symmetry defined as the locus of equidistant points between the first and second side edges.

8. A closure as in claim 7, wherein the inner film hinge is symmetric to the outer film hinge along a lateral axis of symmetry defined as the locus of equidistant points between the curved inner web end and the curved outer web end.

9. A closure as in claim 1, wherein the center space is not less than one-third the distance between the inner film hinge and the outer film hinge at the first and second side edges.

10. A closure as in claim 1, wherein the partially-cylindrical-surface configuration of the web-hinge structure has a radius of curvature more than twice the lesser radius of curvature of the inner and outer film hinges.

11. A closure as in claim 1, wherein the inner film hinge has a radius of curvature less than a radius of curvature of the cap.

12. A closure as in claim 1, wherein the outer film hinge has a radius of curvature less than a radius of curvature of the cover.

* * * * *